US009259042B2

(12) United States Patent
Lee

(10) Patent No.: US 9,259,042 B2
(45) Date of Patent: Feb. 16, 2016

(54) AGRICHEMICAL SPRAY MASK

(76) Inventor: Young Sang Lee, Jeju-Dp (KR)

( * ) Notice: Subject to any disclaimer, the term of this patent is extended or adjusted under 35 U.S.C. 154(b) by 224 days.

(21) Appl. No.: 13/884,321

(22) PCT Filed: Nov. 11, 2011

(86) PCT No.: PCT/KR2011/008630

§ 371 (c)(1),
(2), (4) Date: May 9, 2013

(87) PCT Pub. No.: WO2012/064152

PCT Pub. Date: May 18, 2012

(65) Prior Publication Data

US 2013/0228184 A1 Sep. 5, 2013

(30) Foreign Application Priority Data

Nov. 11, 2010 (KR) ..... 10-2010-0112245

(51) Int. Cl.
*A62B 7/10* (2006.01)
*A41D 13/11* (2006.01)
*A62B 18/02* (2006.01)

(52) U.S. Cl.
CPC . *A41D 13/11* (2013.01); *A62B 7/10* (2013.01); *A62B 18/025* (2013.01); *A41D 13/1138* (2013.01); *A41D 13/1161* (2013.01)

(58) Field of Classification Search
CPC ..... A62B 7/10; A62B 19/00; A62B 23/02; B01D 39/163; B01D 39/2062; B01D 46/00; B01D 2239/065; B01D 2239/086; B01D 2239/10
USPC ..... 55/486, 511, DIG. 33, DIG. 35; 128/205.27, 205.29, 206.17
See application file for complete search history.

(56) References Cited

U.S. PATENT DOCUMENTS 2,787,333 A * 4/1957 Boone et al. ..... 96/139
4,179,274 A * 12/1979 Moon ..... 55/524
4,548,626 A * 10/1985 Ackley et al. ..... 96/139

(Continued)

FOREIGN PATENT DOCUMENTS

JP 3071171 U 8/2000
JP 3076433 U 4/2001

(Continued)

*Primary Examiner* — Duane Smith
*Assistant Examiner* — Minh-Chau Pham
(74) *Attorney, Agent, or Firm* — AKC Patents, LLC; Aliki K. Collins

(57) ABSTRACT

An agrichemical spray mask according to the present invention comprises: a main body (114) which is worn hermetically attached to the face and has an inhalation inlet port (110) and an exhalation outlet port (112); an anti-dust and anti-toxin filter tube (120) which is provided on the outside of the inhalation inlet port (110) of the main body (114) of the mask so as to link to the inhalation inlet port and is provided with an anti-dust and anti-toxin filter (113); and a spray filter tube which is separably fastened to the anti-dust and anti-toxin filter tube (120), has a spray filter (223) provided on the inside thereof, and has a respiration port (220*a*). In the present invention, because two-stage filtering is used to ensure that agrichemical sprays are not breathed in via the human respiratory organs and at the same time the filter is not much soaked by the agrichemicals, it follows that the time over which the mask is used can be extended and, if the filter does become soaked with agrichemicals, the filter can easily be replaced and cleaned.

10 Claims, 3 Drawing Sheets

(56) References Cited

U.S. PATENT DOCUMENTS

| | | | | |
|---|---|---|---|---|
| 4,714,486 | A * | 12/1987 | Silverthorn | 96/134 |
| 6,874,499 | B2 * | 4/2005 | Viner et al. | 128/201.25 |
| 7,419,526 | B2 * | 9/2008 | Greer et al. | 55/512 |
| 8,460,423 | B2 * | 6/2013 | Legare et al. | 55/486 |
| 2005/0160911 | A1 | 7/2005 | Friday et al. | |
| 2006/0283453 | A1 | 12/2006 | Haddad | |

FOREIGN PATENT DOCUMENTS

| | | | |
|---|---|---|---|
| KR | 20-1981-0001062 | Y1 | 9/1981 |
| KR | 20-0285157 | Y1 | 8/2002 |

* cited by examiner

AGRICHEMICAL SPRAY MASK

CROSS-REFERENCE TO RELATED APPLICATION

This application claims the benefit of Korean Patent Application No. 10-2010-0112245, filed on Nov. 11, 2011 in the Korean Intellectual Property Office, the disclosure of which is incorporated herein by reference.

TECHNICAL FIELD

The present invention relates to an agrichemical spray mask which is suitable for use in spraying agrichemicals, and more particularly, to an agrichemical spray mask which is configured to use two-stage filtering to ensure that agrichemicals are not inhaled through the human respiratory organs, is configured to make a filter not soaked with the agrichemicals to extend a mask wearing time, and is configured to use the filter which can easily be replaced and cleaned when the filter becomes soaked with agrichemicals.

BACKGROUND ART

An agrichemical spray mask is not used to prevent dust or a poisonous gas in a farm where agrichemicals are sprayed, but a spraying person generally uses the agrichemical spray mask to protect oneself from the noxious agrichemicals the person sprays. Generally, the agrichemicals are diluted with water to be sprayed, and the spray-shaped microscopic pesticide droplets are included in an inhaled gas or are adhered to a human body surface to cause the human body any harm.

Because of the reason, it is disclosed in the safe use standard of agricultural chemicals to certainly wear a mask, gloves and a prevention wear in spraying agrichemicals. Concerning the gloves and the prevention wear, persons mostly wear the similar gloves and a prevention wear without a big difference, but concerning the mask, persons wear various type masks from a simple cotton mask to a gas mask completely covering a head. Particularly, a certain farmer does not wear a mask depending on a proverb that if a farmer is afraid of agrichemicals, he cannot farm. A farmer, who throws off the mask and sprays the agrichemicals, does the behavior because the utility of the related art mask is very low. That is, it is not because the farmer acts with reckless bravado or is ignorant.

The agrichemicals unlike the poisonous gas are sprayed in a shape of water drops, and thus, an agrichemical mask has to be divided from a general anti-dust and anti-toxin mask used for preventing dust and a poisonous gas. However, because the agrichemical mask is manufactured in a process which is not different from a process manufacturing the general anti-dust and anti-toxin mask, the inefficiency occurs.

A cheap and convenient cotton mask is easily soaked by the agrichemical sprays, and thus, even though a short time elapses after wearing the cotton mask, the wearing of the cotton mask is not different from taking off the cotton mask. In the case of an expensive anti-dust and anti-toxin mask, a very important filter is exposed to be easily soaked by the agrichemical sprays, and thus, within several minutes, the filter is soaked. Therefore, the anti-dust and anti-toxin mask is not different from the cotton mask in quality. That is, the related art cotton mask or the related art anti-dust and anti-toxin mask is only suitable for preventing dust or a poisonous gas, and is not suitable when the agrichemicals in a shape of wet type mist is sprayed.

FIG. 1 is an exemplary diagram for describing a related art anti-dust and anti-toxin mask, and FIG. 2 is an exemplary diagram for describing an anti-dust and anti-toxin filter tube 20 shown in FIG. 1. Referring to FIGS. 1 and 2, a mask main body includes an edge having a slight curve along a face such that the mask main body 14 closely contacts the face having a nose and a mouth, and is formed of a rubber or a synthetic resin with elasticity.

An inhalation inlet port 10 is formed in front surface of the mask main body 14, and an exhalation outlet port 12 is formed in a bottom surface. An anti-dust and anti-toxin filter tube 20 is coupled to an outside of the inhalation inlet port 10, and a head string connecting means 22 is disposed between the anti-dust and anti-toxin filter tube 20 and the mask main body 14. A head string 24 is disposed to be extended from the head string connecting means 22 at each of the both end portions of the head string connecting means 22.

The anti-dust and anti-toxin filter tube 20 includes a main body connecting part 11 coupled to the inhalation inlet port 10 and a cover 9 covering the main body connecting part 11, and an anti-dust and anti-toxin filter 13 is disposed between the main body connecting part 11 and the cover 9. A respiration port 9*a* through which air is inhaled in an inhalation is formed in the cover 9, and a respiration path 11*a*, through which an inhaled air passing the anti-dust and anti-toxin filter 13 passes, is formed in the main body connecting part 11.

In the main body connecting part 11, a stop ring plate 16 is formed to be protruded from a surface facing the mask main body 14, along the outer circumference part of the respiration path 11*a*. Also, a respiration plate 28 is disposed inside of the main body connecting part 11. The respiration plate 28 is pushed toward the mask main body 14 to be separated from the stop ring plate 16 to open the respiration path 11*a* when the inhaled air is coming through the respiration path 11*a*, is pushed toward the respiration path 11*a* to closely contact the stop ring plate 16 to close the respiration path 11*a* in an exhalation, and is formed of a thin rubber. The stop ring plate 16 has a diameter greater than the inhalation inlet port 10, and the anti-dust and anti-toxin filter tube 20 is coupled to the mask main body 14 by opening the inhalation inlet port 10 to forcibly insert the stop ring plate 10 into the inhalation inlet port 10.

In the above-described related art anti-dust and anti-toxin mask, because the agrichemical sprays coming through the inhalation port 9*a* in the inhalation immediately contacts the anti-dust and anti-toxin filter 13, the anti-dust and anti-toxin filter 13 is soaked within several minutes after spraying the agrichemicals. Therefore, the anti-dust and anti-toxin filter 13 does not perform the original function, and is plugged, and thus, it is difficult to breathe.

Thus, it is required to instantly replace the anti-dust and anti-toxin filter 13. However, because the anti-dust and anti-toxin filter applied to the anti-dust and anti-toxin mask is used for filtering gas and minute dry particles, the anti-dust and anti-toxin filter 13 is very elaborate, and very expensive, and thus, it is onerous to prepare several numbers of the anti-dust and anti-toxin filters 13 for replacement, in a price.

Also, even though the replacement is performed, it is required to clean the anti-dust and anti-toxin filter 13. However, it is required to pay careful attention so as to clean the anti-dust and anti-toxin filter 13 without damaging the elaborate configuration of the anti-dust and anti-toxin filter 13, a frequent clean shortens the life of the anti-dust and anti-toxin filter 13, and thus, it is required to prepare several numbers of the anti-dust and anti-toxin filters 13 for the replacement.

If the anti-dust and anti-toxin filter 13 is seriously soaked, the agrichemical sprays are gathered together, and thus, the agrichemical sprays in a shape of water drops flows into an inside of the mask main body 14. Therefore, it is impossible to use the anti-dust and anti-toxin filter 13 without a replacement. Particularly, because the related art anti-dust and anti-toxin mask considers the dry dust or gas, it is not important to consider a position of the inhalation port 9*a*, and thus, as shown in FIG. 2, the inhalation port 9*a* is disposed in a front surface.

Therefore, when the agrichemicals are upwardly sprayed in place such as orchard where there are very tall trees, a spraying person looks up, and thus, the spraying person gets the agrichemicals falling with gravity. Therefore, it is useless to wear the related art anti-dust and anti-toxin mask. This causes the above-describe situation where some farmers feel free to spray the agrichemicals without wearing a mask.

DISCLOSURE OF INVENTION

Accordingly, the present invention is directed to provide an anti-dust and anti-toxin mask, which substantially obviates one or more problems due to limitations and disadvantages of the related art. An aspect of the present invention is directed to provide an anti-dust and anti-toxin mask, which is configured to use two-stage filtering to prevent agrichemicals from approaching human respiratory organs or a face, is configured to make a filter not soaked with the agrichemicals to extend a mask wearing time, is configured to use the filter which can easily be replaced and cleaned when the filter becomes soaked with agrichemicals, and is configured to prevent the agrichemicals from directly coming to an inside of a mask even though a user looks up.

To achieve these and other advantage and in accordance with the purpose of the invention, as embodied and broadly described herein, there is provided an anti-dust and anti-toxin mask, which includes: a mask main body configured to be worn at a face, and configured to have an inhalation inlet port and an exhalation outlet port; an anti-dust and anti-toxin filter tube configured to be disposed in an outside of the inhalation inlet port of the mask main body to be coupled to the inhalation inlet port, and configured to have an anti-dust and anti-toxin filter disposed in an inside of the anti-dust and anti-toxin filter tube; and a spray filter tube configured to be detachably coupled to the mask main body or the anti-dust and anti-toxin filter tube to be coupled to the anti-dust and anti-toxin filter tube, configured to have a spray filter disposed in an inside of the spray filter, and configured to have a respiration port.

Here, the respiration port may be disposed in a bottom surface of the spray filter tube, and a respiration guide means may be disposed in an inlet port of the respiration port to guide an air from a face direction to a direction of the respiration port.

A stopper for preventing the anti-dust and anti-toxin filter and the spray filter from contacting each other may be disposed between the anti-dust and anti-toxin filter tube and the spray filter tube, and the stopper may be disposed in at least one of the anti-dust and anti-toxin filter tube and the spray filter tube.

The spray filter tube may be coupled to the anti-dust and anti-toxin filter tube to cover an outside of the anti-dust and anti-toxin filter tube, and the stopper may be disposed in the anti-dust and anti-toxin filter tube. A coupling guide pipe is disposed to protrude from the mask main body to surround the anti-dust and anti-toxin filter tube, and the spray filter tube is forcibly inserted between the anti-dust and anti-toxin filter tube and the coupling guide pipe to be coupled.

An inner surface of the spray filter tube and an outer surface of the anti-dust and anti-toxin filter tube may be coupled to each other in a bolt shape.

The spray filter tube may be disposed to be inclined downward from the mask main body to an outside.

The spray filter tube may be adhered to the anti-dust and anti-toxin filter tube by making an adhesive tape pass a front surface of the spray filter tube.

Advantageous Effects

According to the embodiments of the present invention, it is possible to prevent agrichemicals from being inhaled through the human respiratory organs by using two-stage filtering, it is possible to extend a mask wearing time because a filter is not well soaked with the agrichemicals, and it is easy to replace and clean a filter when the filter becomes soaked with agrichemicals. Also, it is possible to prevent the agrichemicals from directly coming to an inside of a mask even though a user looks up. Because the anti-dust and anti-toxin mask according to the present invention is very useful for spraying the agrichemicals, the anti-dust and anti-toxin mask contributes to decrease the pesticide poisoning accidents and increase a spray of the agrichemicals.

BRIEF DESCRIPTION OF DRAWINGS

The accompanying drawings, which are included to provide a further understanding of the invention and are incorporated in and constitute a part of this application, illustrate embodiments of the invention and together with the description serve to explain the principle of the invention. In the drawings.

DESCRIPTIONS OF REFERENCE NUMBERS

Figure 1:
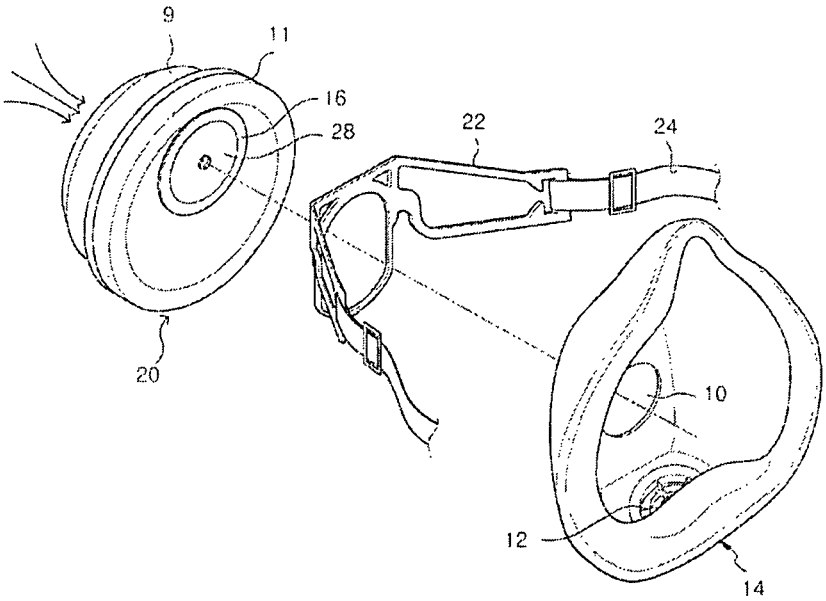
FIG. 1 is an exemplary diagram for describing a related art anti-dust and anti-toxin mask.
Figure 2:
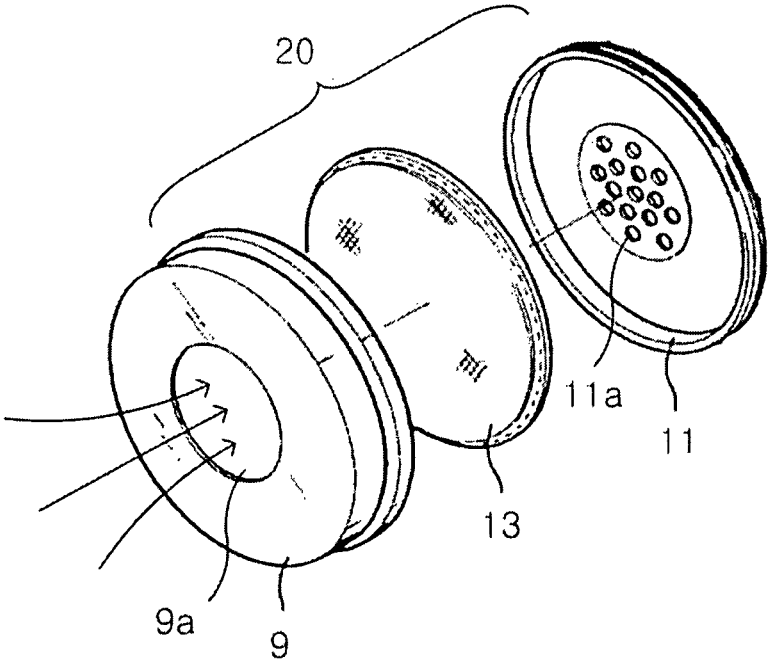
FIG. 2 is an exemplary diagram for describing an anti-dust and anti-toxin filter tube 20 shown in FIG. 1.

110: inhalation inlet port
112: exhalation outlet port
113: anti-dust and anti-toxin filter
114: mask main body
120: anti-dust and anti-toxin filter tube
121, 221: stopper
122: coupling guide pipe
128: respiration plate
138: exhausting plate
220: spray filter tube
220*a*: respiration port
223: spray filter
230: filter support
240: respiration guide means

BEST MODES FOR CARRYING OUT THE INVENTION

Reference will now be made in detail to the exemplary embodiments of the present invention, examples of which are illustrated in the accompanying drawings. Wherever possible, the same reference numbers will be used throughout the drawings to refer to the same or like parts. Hereinafter, embodiments of the present invention will be described in detail with reference to the accompanying drawings.

The First Embodiment

Figure 3:
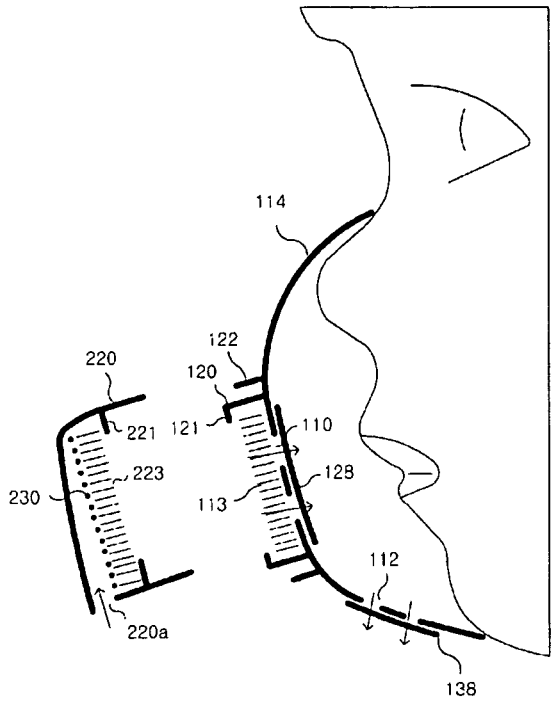
FIGS. 3 to 5 are exemplary diagrams for describing an agrichemical spray mask according to embodiments of the present invention.

FIG. 3 is an exemplary diagram for describing an agrichemical spray mask according to a first embodiment of the present invention. As shown in FIG. 3, a mask main body 114 includes an edge having a slight curve along a face such that the mask main body 14 closely contacts the face having a nose and a mouth, and is formed of a rubber or a synthetic resin with elasticity. An inhalation inlet port 110 is formed in a front surface of the mask main body 114, an exhalation outlet port 112 is formed in a bottom surface of the mask main body 114, and a respiration plate 128 and an exhausting plate 138 is respectively formed in the inhalation inlet port 110 and the exhalation outlet port 112.

The respiration plate 128 is disposed in an inside of the inhalation inlet port 110 such that the respiration plate 128 is pushed inward by a respiration air in an inhalation to open the inhalation inlet port 110 and is pushed outward by an exhausting air in an exhalation to close the inhalation inlet port 110. The exhausting plate 138 is disposed in an outside of the exhalation outlet port 112 such that exhausting plate 138 is pushed inward by a respiration air in an inhalation to close the exhalation outlet port 112 and is pushed outward by an exhausting air in an exhalation to open the exhalation outlet port 112.

An anti-dust and anti-toxin filter tube 120 is disposed in an outside of the inhalation inlet port 110 of the mask main body 114 so as to be coupled to the inhalation inlet port 110, and an anti-dust and anti-toxin filter 113 is disposed in an inside of the anti-dust and anti-toxin filter tube 120. A spray filter tube 220 is detachably coupled to the anti-dust and anti-toxin filter tube 120, a spray filter 223 is disposed in the spray filter tube 220, and the spray filter tube 220 has a respiration port 220*a* which is an inlet port of an air respiration.

Because the spray filter directly contacts the agrichemical sprays, the spray filter 223 is easily soaked. Therefore, if the spray filter 223 and the anti-dust and anti-toxin filter 113 closely contact each other, even the anti-dust and anti-toxin filter 113 is easily soaked, and thus, to prevent the spray filter 223 and the anti-dust and anti-toxin filter from contacting each other, stoppers 121 and 221 are disposed between the spray filter 223 and the anti-dust and anti-toxin filter 113.

The anti-dust and anti-toxin filter 113 performs a function filtering an agrichemical residue which is dried and is vaporized when the agrichemicals passes the spray filter 223. The stoppers 121 and 221 includes an anti-dust and anti-toxin stopper 121 disposed in an inside of the anti-dust and anti-toxin filter tube 120, and a spray filter stopper 221 disposed in an inside of the spray filter tube 220. A filter support 230 is disposed between the respiration port 220*a* and the spray filter 223 such that the spray filter 223 maintains an equally spreading state in the gross, and a plurality of air paths are formed in the filter support 230. The spray filter 223 is disposed between the spray filter stopper 221 and the filter support 230 in a spreading state.

The stoppers 121 and 221 are for preventing the two filters 223 and 113 from contacting each other, and thus, two stoppers are not required. Therefore, it is possible to install the stopper at one of the two filters 223 and 113. The filter stoppers 121 and 221 also fix the filters 113 and 223. To maintain a function as the anti-dust and anti-toxin mask after separating the spray filter tube 220 from the anti-dust and anti-toxin mask, the anti-dust and anti-toxin filter 113 is required not to be separated from the anti-dust and anti-toxin filter tube 120 after the spray filter tube 220 is separated from the anti-dust and anti-toxin mask. Therefore, when one of the two stoppers 121 and 221 is disposed, it is preferable to install the anti-dust and anti-toxin filter stopper 121 instead of installing the spray filter stopper 221.

As described above, the agrichemical spray mask according to the present invention uses two filter tubes, and thus, is advantageous to be used in an occurrence of a toxic gas as well as in spraying the agrichemicals depending on a state.

A coupling guide pipe 122 is disposed to protrude from the mask main body 120 so as to surround the anti-dust and anti-toxin filter tube 120. The spray filter tube 220 is forcibly inserted between the anti-dust and anti-toxin filter tube 120 and the coupling guide pipe 122 to be coupled.

The agrichemical sprays are microscopic water drops, and have mass, and thus, have the characteristic falling to the ground with gravity. Therefore, to decrease a probability that the agrichemical sprays come through the respiration port 220*a* in an inhalation, it is preferable to install the respiration port 220*a* in a bottom surface of the spray filter tube 220 instead of installing the respiration port 220*a* in a front surface of the spray filter tube 220.

Figure 4:
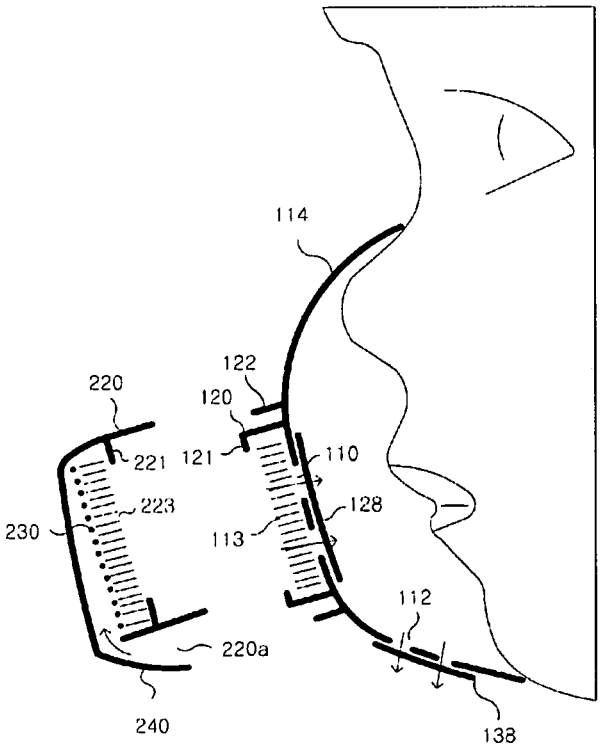

When the agrichemicals are upwardly sprayed in place such as orchard where there are very tall trees, a spraying person looks up. Therefore, as shown in FIG. 3, even though the respiration port 220*a* is disposed in a bottom surface of the spray filter tube 220, the agrichemical sprays are breathed, and thus, it is preferable to install a respiration guide means 240 guiding an air from a face direction of a wearer to a direction of the respiration port 220*a*, in an inlet port of the respiration port 220*a* as shown in FIG. 4.

Figure 5:
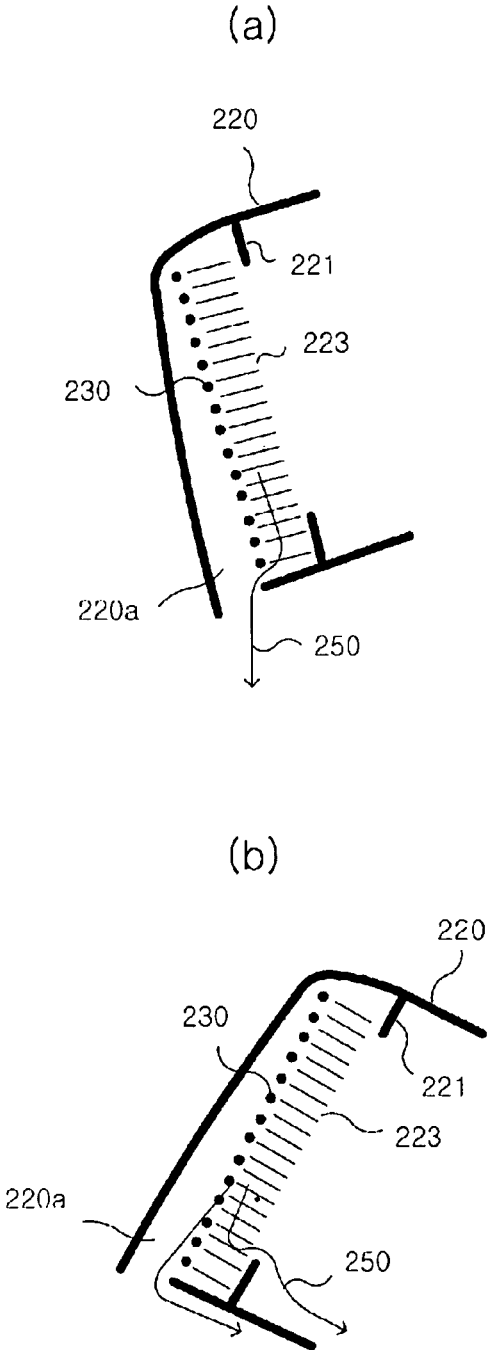

As shown in a portion (b) of FIG. 5, if the spray filter tube 220 faces upward, when the spray filter 223 is soaked, the agrichemical sprays are gathered together in a shape of water drops to flow into a face of the wearer, and thus, it is not preferable. Therefore, as shown in a portion (a) of FIG. 5, it is preferable to install the spray filter tube 220 such that the spray filter tube 220 is inclined downward from the mask main body 114 to an outside.

The spray filter tube 220 may be formed in a shape of a circular bottle cap, and may be disposed in an outside of the anti-dust and anti-toxin filter tube. The spray filter 223 disposed in an inside of the spray filter tube 220 has a configuration less elaborate than that of the anti-dust and anti-toxin filter 113. When the spray filter tube 220 has a shape of a bottle cap, the spray filter tube 220 may be turned as a bolt to be coupled or may be attached by an adhesive tape.

Even though the spray filter tube 220 may be formed in a shape of a bottle cap, the spray filter tube 220 may be formed in a shape of a square bottle cap. When a real inner coupling part is circular, the spray filter tube 220 may be turned as a bolt to be coupled, but when a shape of the spray filter tube 220 is not circular, it is preferable to fix the spray filter tube 220 by using the adhesive tape. In this case, because the respiration port 220*a* is not disposed at a front surface, but at a bottom surface, the spray filter tube 220 may be stably and easily coupled by making the adhesive tape pass the front surface of the spray filter tube 220 to be adhered.

The invention claimed is:

1. An agrichemical spray mask comprising:

a mask main body configured to be worn at a face, and configured to have an inhalation inlet port and an exhalation outlet port;

an anti-dust and anti-toxin filter tube configured to be disposed in an outside of the inhalation inlet port of the mask main body to be coupled to the inhalation inlet port, and configured to have an anti-dust and anti-toxin filter disposed in an inside of the anti-dust and anti-toxin filter tube; and a spray filter tube configured to be detachably coupled to the mask main body or the anti-dust and anti-toxin filter tube to be coupled to the anti-dust and anti-toxin filter tube, configured to have a spray filter disposed in an inside of the spray filter tube, and configured to have a respiration port, wherein the respiration port is disposed in a bottom surface of the spray filter tube, and wherein a respiration guide means is disposed in an inlet port of the respiration port to guide an air from a face direction to a direction of the respiration port.

2. The agrichemical spray filter of claim 1, wherein, a stopper for preventing the anti-dust and anti-toxin filter and the spray filter from contacting each other is disposed between the anti-dust and anti-toxin filter tube and the spray filter tube.

3. The agrichemical spray filter of claim 2, wherein, the stopper is disposed in at least one of the anti-dust and anti-toxin filter tube and the spray filter tube.

4. The agrichemical spray filter of claim 2, wherein, the stopper comprises an anti-dust and anti-toxin filter stopper disposed in an inside of the anti-dust and anti-toxin filter tube, and a spray filter stopper disposed in an inside of the spray filter tube.

5. The agrichemical spray filter of claim 3, wherein, the spray filter tube is coupled to the anti-dust and anti-toxin filter tube to cover an outside of the anti-dust and anti-toxin filter tube, and the stopper is disposed in the anti-dust and anti-toxin filter tube.

6. The agrichemical spray filter of claim 5, wherein, an inner surface of the spray filter tube and an outer surface of the anti-dust and anti-toxin filter tube is coupled to each other in a bolt shape.

7. The agrichemical spray filter of claim 5, wherein, a coupling guide pipe is disposed to protrude from the mask main body to surround the anti-dust and anti-toxin filter tube, and the spray filter tube is forcibly inserted between the anti-dust and anti-toxin filter tube and the coupling guide pipe to be coupled.

8. The agrichemical spray filter of claim 1, wherein, the spray filter tube is disposed to be inclined downward from the mask main body to an outside.

9. The agrichemical spray filter of claim 1, wherein, the spray filter tube is adhered to the mask main body or the anti-dust and anti-toxin filter tube by making an adhesive tape pass a front surface of the spray filter tube.

10. The agrichemical spray filter of claim 2, wherein, the spray filter tube is formed in a shape of a bottle cap, the respiration port is formed in a lateral side of the spray filter in a shape of a bottle cap, and the spray filter tube is coupled to the mask main body or the anti-dust and anti-toxin filter tube such that the respiration port faces downward.

* * * * *